US009955265B2

(12) United States Patent
Beer et al.

(10) Patent No.: US 9,955,265 B2
(45) Date of Patent: Apr. 24, 2018

(54) ELECTROACOUSTIC DRIVER

(71) Applicant: Fraunhofer-Gesellschaft zur Foerderung der angewandten Forschung e.V., Munich (DE)

(72) Inventors: Daniel Beer, Martinroda (DE); Lutz Ehrig, Dresden (DE); Lorenz Betz, Wassertruedingen (DE); Philip Leistner, Stuttgart (DE); Karlheinz Bay, Stuttgart (DE); Michael Leistner, Stuttgart (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 14/610,327

(22) Filed: Jan. 30, 2015

(65) Prior Publication Data

US 2015/0146910 A1 May 28, 2015

Related U.S. Application Data

(63) Continuation of application No. PCT/EP2013/054741, filed on Mar. 8, 2013.

(51) Int. Cl.

| | |
|---|---|
| ***H04R 25/00*** | (2006.01) |
| ***H04R 7/00*** | (2006.01) |
| ***H04R 7/16*** | (2006.01) |

(52) U.S. Cl.

CPC ..... *H04R 7/00* (2013.01); *H04R 7/16* (2013.01); *H04R 2207/00* (2013.01)

(58) Field of Classification Search

CPC ..... H04R 7/045; H04R 7/16; H04R 17/00; H04R 9/043

USPC ..... 381/190, 191, 396, 398, 152, 386

See application file for complete search history.

(56) References Cited

U.S. PATENT DOCUMENTS

| | | | | |
|---|---|---|---|---|
| 4,379,951 A * | 4/1983 | Gabr | ..... | H04N 5/642 181/161 |
| 7,382,890 B2 * | 6/2008 | Saiki | ..... | H04R 7/04 381/152 |
| 2004/0218778 A1 | 11/2004 | Weisman | | |

* cited by examiner

*Primary Examiner* — Sunita Joshi

(74) *Attorney, Agent, or Firm* — Perkins Coie LLP; Michael A. Glenn

(57) ABSTRACT

An electroacoustic driver includes a diaphragm, a diaphragm drive system and a diaphragm suspension. The diaphragm system is configured to subject the diaphragm to a motion, wherein the diaphragm suspension is configured to guide the diaphragm. The diaphragm drive system includes an active element configured to actively influence the motion of the diaphragm.

20 Claims, 5 Drawing Sheets

ELECTROACOUSTIC DRIVER

CROSS-REFERENCE TO RELATED APPLICATIONS

This application is a continuation of copending International Application No. PCT/EP2013/054741, filed Mar. 8, 2013, which is incorporated herein by reference in its entirety, and additionally claims priority from U.S. Application No. 61/677,899, filed Jul. 31, 2012, which is also incorporated herein by reference in its entirety.

Embodiments of the present invention refer to an electroacoustic driver comprising a diaphragm suspension having an active element, to an electroacoustic driver comprising a surround configured to actively excite the diaphragm and to an electroacoustic driver comprising a diaphragm drive system arranged at an edge region.

BACKGROUND OF THE INVENTION

An electroacoustic driver typically comprises a lightweight diaphragm which may have a circle- or square-shape, as well as a basket, a diaphragm drive system and a diaphragm suspension. The diaphragm suspension is configured to guide the diaphragm along its motion, wherein the diaphragm drive system is configured to subject the diaphragm to the motion or to an oscillation in order to produce a sound in response to an electric audio signal. The diaphragm is typically deflected by using a coil electromagnet acting on a permanent magnet, wherein the coil is coupled to the diaphragm and the permanent magnet is attached to the basket. The diaphragm suspension elastically mounting the diaphragm and the basket may comprise a spider arranged in the middle of the diaphragm and a surround arranged at an edge region of same. The spider and the surround are typically made by a fabric or a rubber which are passive elements. Each of the passive elements may have a spring stiffness influencing the restoring force counteracting to the excursion of the diaphragm. However, such suspensions often cause deficiencies in sound quality because the surround and/or the spider may typically provide a restoring force having a non-linear characteristic. Therefore, there is the need for an approved approach.

SUMMARY

According to an embodiment, an electroacoustic driver may have: a diaphragm; a diaphragm drive system configured to subject the diaphragm to a motion; and a diaphragm suspension configured to guide the diaphragm; wherein the diaphragm suspension includes an active element and/or piezo electrical element configured to actively influence the motion of the diaphragm.

According to another embodiment, an electroacoustic driver may have: a diaphragm configured to move in a direction of a piston-like motion; and a surround formed along an edge region of the diaphragm so as to guide the diaphragm laterally and along the direction of the piston-like motion, wherein the surround is configured to actively excite the piston-like motion.

According to another embodiment, an electroacoustic driver may have: a diaphragm configured to move in a direction of a piston-like motion; a basket; a diaphragm drive system arranged between an edge region of the diaphragm and the basket, wherein the diaphragm drive system includes one or more electrical devices which are configured to subject the diaphragm to a piston-like motion; and a diaphragm suspension configured to guide the diaphragm laterally and along the piston-like motion.

Embodiments of the present invention provide an electroacoustic driver comprising a diaphragm, a diaphragm drive system and a diaphragm suspension. The diaphragm drive system is configured to subject the diaphragm to a motion (e.g. of an oscillation). The diaphragm suspension is configured to guide the diaphragm, wherein the diaphragm suspension comprises an active element configured to actively influence the motion of the diaphragm.

The approach of the present invention takes account of the fact that non-linearities of a transducer are typically caused by the diaphragm suspension, i.e. by the spider and/or by the surround. In order to compensate the non-linearities at source of same, the diaphragm suspension comprises one or more active elements, e.g. piezoelectrical devices. These active elements enable to exercise an influence on the parameter interfering with the linearity of the transducer, wherein the exerting of the influence may be done by overlapping the restoring force (counteracting to the excursion of the diaphragm) by an additional force which is generated by the one or more active elements of the diaphragm suspension. I.e. that the motion of the diaphragm may be influenced via the diaphragm suspension or components of the diaphragm suspension such that non-linearities caused by the diaphragm suspension may be compensated. Besides the non-linearities caused by the non-linear restoring force, further non-linearities caused by an magnetic field of the drive system of an moving-coil loudspeaker or caused by external conditions, such as temperature effects, or by aging of the transducer components may be reduced by using the active suspension.

Furthermore, the approach enables to integrate the diaphragm suspension and the diaphragm drive system (into one unit) in order to reduce the complexity of the structure of the transducer. A further embodiment provides an electroacoustic driver comprising a diaphragm and a surround formed along an edge region of the diaphragm. The diaphragm is configured to move in a direction of a piston-like motion, wherein the surround guides the diaphragm laterally and along the direction of the piston-like motion. The surround is further configured to actively excite the piston-like motion. Therefore, the surround may comprise one or more electrical devices, like piezoelectrical devices, which are configured to excite a high enough force to the diaphragm in order to subject same to the piston-like motion (i.e. without a conventional drive system comprising a voice coil). Expressed in other word, this means that the surround integrates the diaphragm drive system and the diaphragm suspension into one unit.

According to a further embodiment, the electroacoustic drive system may comprise a diaphragm, a basket, a diaphragm drive system and a diaphragm suspension. The diaphragm is configured to move in a direction of a piston-like motion, wherein the diaphragm suspension is configured to guide the diaphragm laterally and along the piston-like motion. The diaphragm drive system is arranged between an edge region of a diaphragm and the basket comprises one or more electrical devices which are configured to subject the diaphragm to a piston-like motion. To increase the diaphragm stroke, the one or more electrical devices may be arranged in series such that same form a bellow. Furthermore, the one or more electrical devices, for example, being piezoelectrical devices are arranged along the diaphragm suspension, i.e. that the diaphragm drive system is displaced from the middle of the diaphragm to the edge region. According to further embodiments, the diaphragm suspension may be formed by cylinder liner along which the diaphragm performs the piston-like motion.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
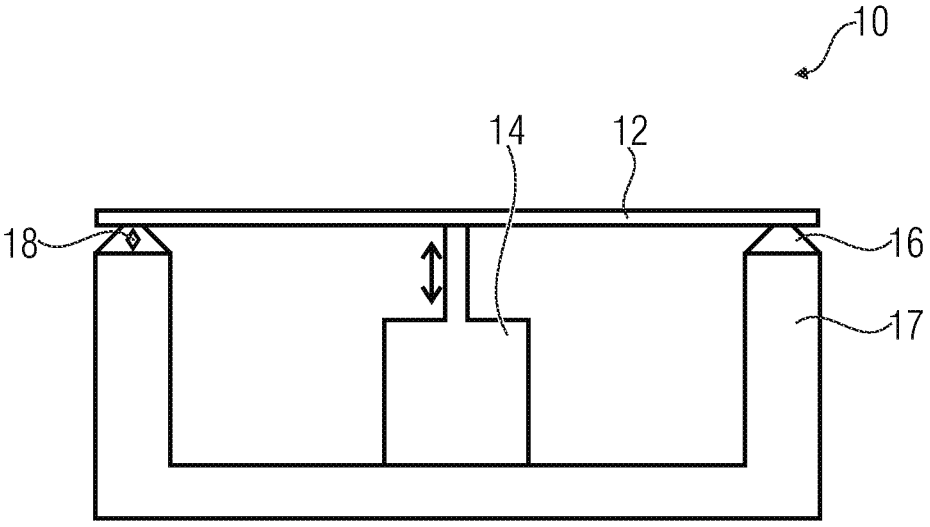
FIG. 1 shows a schematic representation of an electroacoustic driver comprising a diaphragm drive system and a diaphragm suspension having an active element for actively influencing the motion of the diaphragm according to an embodiment.

Below, different embodiments of the present invention will subsequently be discussed referring to FIG. 1 to FIG. 7. In advance, identical reference numbers are provided to objects having identical or similar functions so that objects referred to by identical reference numerals within the different embodiments are interchangeable and the description thereof is mutually applicable.

FIG. 1 shows an electroacoustic driver 10 comprising a movable diaphragm 12, e.g. a diaphragm having disc shape or a round paper cone, in a cross-sectional view. The diaphragm 12 is coupled to a diaphragm drive system 14 and elastically coupled (mounted) by a diaphragm suspension 16. The diaphragm suspension 16 may comprise a flexible element, e.g. a surround, arranged between a frame or a basket 17 and the diaphragm 12 to which the flexible element 16 is directly attached. The diaphragm suspension 16 has the purpose to guide the diaphragm 12 laterally and/or along its motion. Furthermore, the diaphragm suspension 16 comprises one or more active elements 18, e.g. electrical or piezoelectrical devices 18, which may, for example, be integrated into the flexible element 16 or formed by the flexible element 16. Alternatively, the piezoelectrical devices 18 may be formed by a plurality of piezoelectrical strips or piezoelectrical flexure beams. Each of these piezoelectrical strips may be formed by two piezoelectrical strips attached or glued to each other (like bimetal strips). Typically, the diaphragm drive system 14 is also connected to the basket 17 and, thus, configured to subject a relative motion between the diaphragm 12 and the basket 17.

The motion may be a piston-like motion or a bending-wave motion, or, to be precise, a piston-like or bending-wave oscillation. Therefore, the drive system 14 exerts force to the diaphragm 12 such that the diaphragm 12 performs a positive motion to the front side of the diaphragm 12 or a negative motion to the backside of same. As a consequence of the positive and/or the negative motion the flexible suspension element 16 is deformed. While deforming the flexible element 16 same counteracts to the excursion of the diaphragm 12 with a restoring force. This restoring force is typically dependent on the excursion of the diaphragm 12. However, the relationship between the excursion of the diaphragm 12 and the restoring force shows a non-linear characteristic. These non-linearities especially occurring under dynamic load may lead to deficiencies in sound quality. Furthermore, the non-linear characteristic starts to increase already with a low percentage of the excursion of the diaphragm 12.

Thus, in order to avoid the non-linearities of the diaphragm suspension 16, i.e. to provide a transmission characteristic between the excursion of the diaphragm 12 and the restoring force which is as linear as possible, the active elements 18 are provided to the (typically passive) suspension element 16. This active element 18 attached or integrated into the flexible element 16 is configured to influence positively and/or negatively the restoring force to the diaphragm 12 or, consequently, to actively influence the motion of the diaphragm 12. Therefore, the restoring force may be adjusted (i.e. reduced or increased) by overlaying same with an additional force generated by the active element 18.

The further force is controlled dependent on the excursion of the diaphragm 12 so that the non-linear range of the transmission characteristic may be corrected, i.e. that the further force overlaying the restoring force may be applied only when the excursion of the diaphragm 12 is above a threshold level, wherein no force may be applied when the excursion is below this threshold level. This threshold level indicating the border between the linear range and the non-linear range may be dependent on material properties of the flexible element 16, on the shape of the flexible element 16 and/or on further factors of influence like environmental conditions. The further factors of influence may comprise environmental conditions like temperature or the ambient pressure or the aging of the flexible elements 16 or of the diaphragm 12. In turn, this means that the active element 18 may optionally be configured to compensate the above factors of influence by adjusting the overlaying force generated by the active element 18.

Below, the controlling of the active element 18 will be discussed. According to further embodiments, the active devices 18 are controlled via an electrical control signal. This electrical control signal may depend on the audio signal which controls the motion of the diaphragm 12 via the diaphragm drive system 14. Therefore, the control signal may be deduced from the audio signal, for example, by high-pass filtering same or by processing the audio signal by using a lookup table.

According to another embodiment the control signal may be based on a sensor signal output by a sensor for determining non-linearities of the diaphragm 12 or for determining the transmission characteristic of the diaphragm suspension 16. Therefore the driver 10 may optionally comprise a sensor which is coupled to the diaphragm suspension or the diaphragm 12 for detecting the transmission characteristic. For example, the sensor may also be a piezoelectric device or may be formed by one of the active elements (piezoelectric devices) because such (piezoelectric) devices are typically configured to apply and to detect a force. Alternatively, the sensor may be a Hall Effect device which is configured to measure the magnetic field based on which non-linearities are detectable. Such sensors may comprise a processing unit configured to output the control signal for the active device 18 based on the sensor signal. Alternatively, the sensor described above may be implemented by a network comprising a plurality of sensors and a processing unit configured to process the different signals of the sensor and to output the control signal for the active devices 18.

Figure 2A:
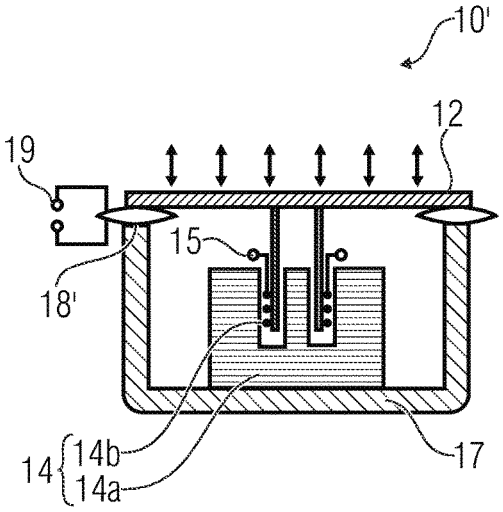
FIGS. 2*a,b* show schematic representations of an electrodynamic driver having the active element, according to FIG. 1, integrated between an edge region of the diaphragm and a basket.
Figure 2B:
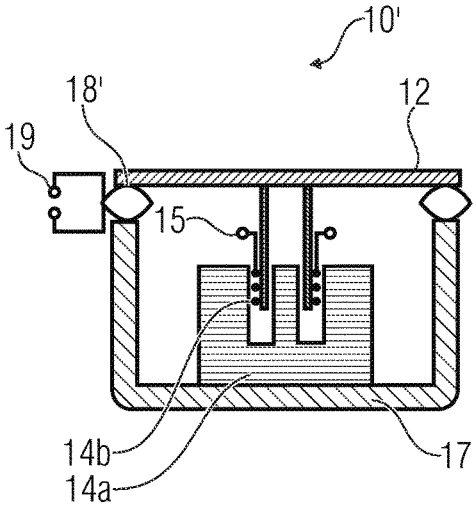
FIG. 2*c* shows an exemplary representation of an electrodynamic driver having the active element of FIG. 1 integrated into a surround of the diaphragm.

FIGS. 2*a* and 2*b* show a cross-sectional view of an implementation of the electroacoustic driver 10' which comprises the diaphragm 12 and the active (suspension) element 18' arranged between the basket 17 and the diaphragm 12. In more detail, the active element 18' is arranged all the way around the diaphragm edge region such that the diaphragm 12 is attached to the basket 16' via the active element 18'. The active suspension element 18' has the shape of a toroid configured for changing the height. The compressed toroid 18' is illustrated by FIG. 2*a*, wherein the expanded state is illustrated by FIG. 2*b*. This deformation of the active suspension element 18' is controllable via a control signal applied to same. The active suspension element 18' may have two connecting tabs 19 for electrically connecting same, e.g. via a processing unit.

In the embodiments shown in FIGS. 2*a* and 2*b*, the diaphragm drive system 14 is formed by a permanent magnet 14*a* attached to the basket 17 and a voice coil 14*b* coupled to the diaphragm 12. Thus, the drive system acts as a plunger coil having just one motion direction so that in this embodiment the motion of the diaphragm 12 is limited to a piston-like motion. It should be noted that the voice coil 14*b* comprises two connecting tabs 15 for electrically connecting the drive system 14 such that the audio signal may be applied to same according to which the diaphragm 12 should be moved or should be caused to oscillate.

During the motion of the diaphragm 12 the air gap between the voice coil 14*b* and the permanent magnet 14*a* should remain constant or nearly constant. For insuring this, the active (suspension) element 18' is configured to guide the diaphragm 12 laterally and along the motion.

Figure 2C:
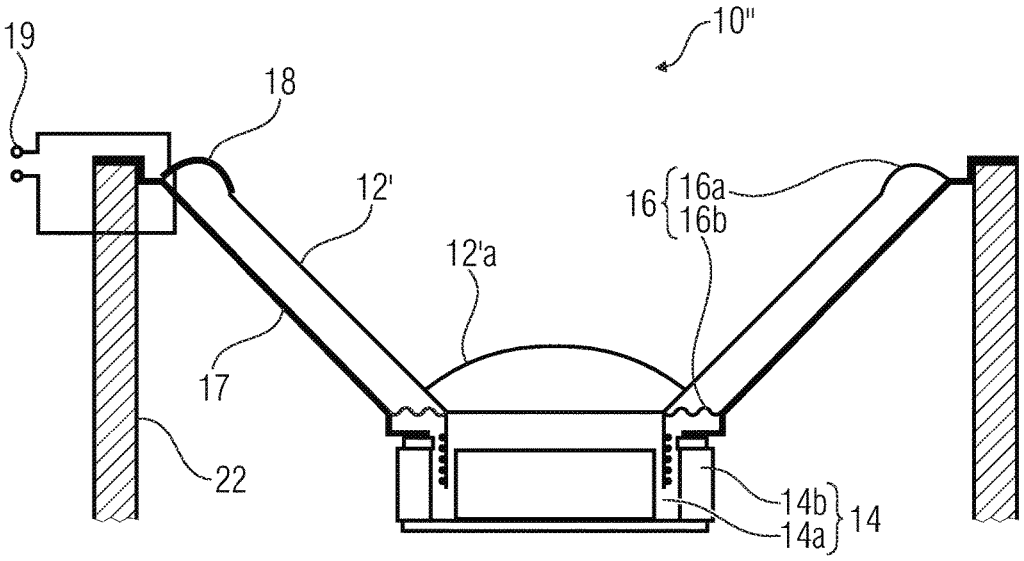

To prove this laterally guiding, the diaphragm suspension may have another component, as illustrated by FIG. 2*c*. FIG. 2*c* shows a driver 10' comprising a diaphragm 12 having a cone-shape and a basket 17 which may be connected to a loudspeaker housing 22. The drive system 14 is formed by the permanent magnet 14*a* and the coil 14*b* attached to the cone-shaped diaphragm 12. In this embodiment, the diaphragm suspension 16 is divided into an inner part and an outer part. The outer part is formed by a surround 16*a* arranged at the edge region of the diaphragm 12, wherein the inner part is formed by a spider 16*b*, arranged between the basket 17 and the diaphragm 12 next to a so-call dust cover 12'*a* of the cone-shaped diaphragm 12. It should be noted that the spider 16*b* may have a higher impact to the restoring force when compared to the impact caused by the surround 16*a*, which mainly has the purpose to seal the diaphragm 12' and the basket 17 or the loudspeaker house 22.

The surround 16*a* comprises the active elements 18 via which the restoring force may be adjusted. Here, the active elements 18 may be integrated into the surround 16*a* or advantageously bonded to the surround 16*a*. As discussed with respect to FIGS. 2*a* and 2*b* the active elements 18 are electrically connectable via the connecting tabs 19 in order to control same.

Each of the embodiments discussed below is illustrated by two figures showing cross-sections of electroacoustic drivers, namely Fig. A and Fig. B, to illustrate the motion of the diaphragm 12. In each figure, the Fig. A illustrates the initial state while Fig. B illustrates the deflected state.

Figure 3A:
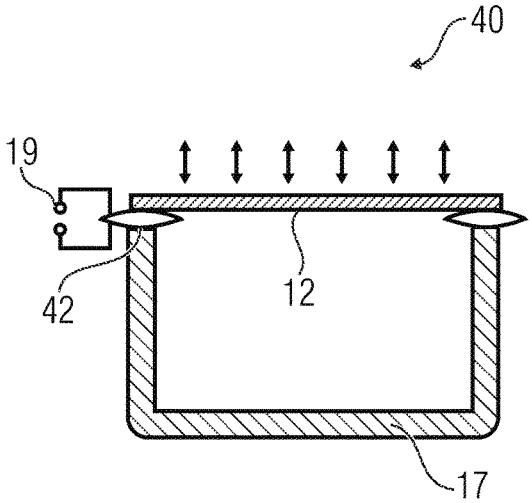
FIGS. 3*a,b* show schematic representations of an electroacoustic driver having a diaphragm, a basket and a diaphragm drive and suspension system arranged between an edge region of the diaphragm and the basket.
Figure 3B:
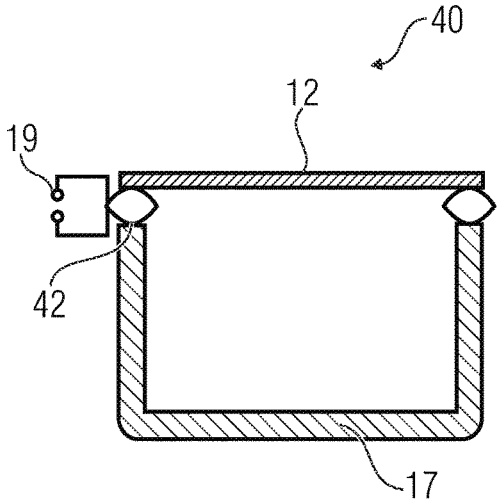

FIGS. 3*a* and 3*b* show an electroacoustic driver 40 comprising an optional basket 17 and a diaphragm 12 configured to move in a direction of a piston-like motion. This motion is subjected by a diaphragm drive and suspension system 42, which is arranged between an edge region of the diaphragm 12 and the basket 17. The diaphragm drive and suspension system 42 may have the shape of a toroid (cf. FIGS. 2*a* and 2*b*, active element 18') or may be integrated into the surround.

The diaphragm drive and suspension system 42 may comprise a plurality of piezoelectric devices (actuators) for actively exciting the piston-like motion of the diaphragm 12. This motion and especially the expansion of the diaphragm drive and suspension system 42 is illustrated by FIG. 3*b*. For active exciting the motion of the diaphragm 12, the one or more active devices are configured to exert a (positive and/or negative) force to the diaphragm 12. This active exciting of the motion is controlled via an audio signal applied via the connecting tabs 19. Each toroid element or toroid brass of the diaphragm drive and suspension system 42 may change its bend radius and/or its length, if the audio signal, e.g. an AC voltage, is applied to same. The change of the length or of the bending radius may lead to a change of the shape of the diaphragm drive and suspension element 42, such that the diaphragm is moved in the direction of the piston-like motion.

Furthermore, the diaphragm drive and suspension system 42 has the purpose to guide the diaphragm 12 laterally and along the direction of the piston-like motion. By adapting the control signal applied via the connecting tabs 19 non-linearities of the diaphragm 12 caused by the suspension may be avoided or compensated, as discussed above. According to further embodiments the diaphragm drive and suspension system 42 may have the purpose to seal the diaphragm 12 relatively to the basket 17. Expressed in other words this means that the diaphragm drive and suspension system 42 integrates the diaphragm drive system and the diaphragm suspension system into one unit, for example into the surround.

Figure 4A:
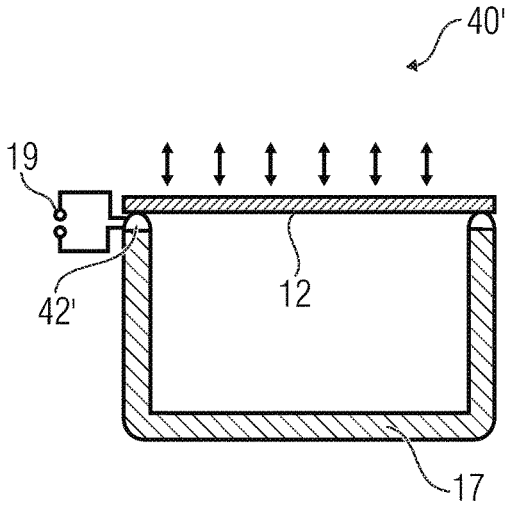
FIGS. 4*a,b* show schematic representations of an electroacoustic driver having a diaphragm, a basket and a diaphragm drive and suspension system arranged between an edge region of the diaphragm and the basket.
Figure 4B:
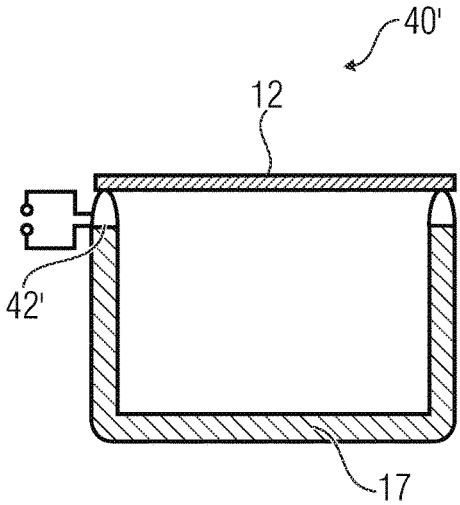

FIGS. 4*a* and 4*b* show a further implementation of an electroacoustic driver 40' which comprises a different implementation of the diaphragm drive and suspension system 42'. Here, the diaphragm drive and suspension system 42' is formed by a toroid brass which enables better suspension properties but a smaller excursion of the diaphragm 12 (cf. FIG. 4*b*). Although the diaphragm drive and suspension system 42 differs from the diaphragm drive and suspension system 42' regarding its shape, the functionality of same may be similar.

Figure 5A:
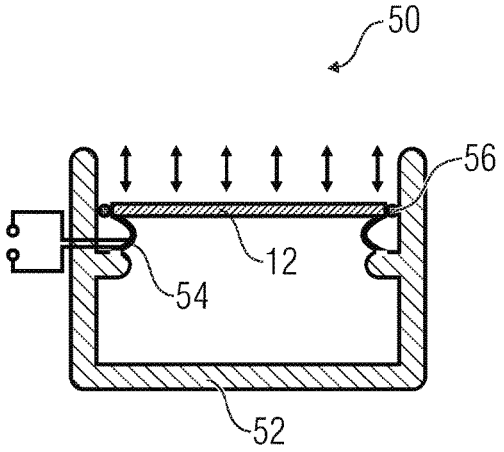
FIGS. 5*a,b* show schematic representations of an electroacoustic driver having a diaphragm, a basket, a diaphragm suspension formed by a cylinder liner and a diaphragm drive system arranged between an edge region of the diaphragm and the basket.
Figure 5B:
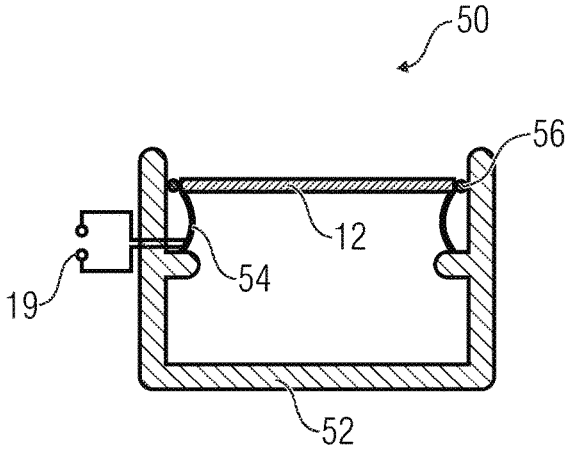

FIGS. 5*a* and 5*b* show a further electroacoustical driver 50 comprising the diaphragm 12, a basket 52 and a diaphragm drive system 54 as well as a diaphragm suspension system 56. Here, the function of subjecting the diaphragm 12 to a piston-like motion and the function of guiding the diaphragm 12 laterally and along the piston-like motion are separated, wherein the diaphragm drive system 54 is substantially equal to the drive system shown in FIGS. 3*a,b* and 4*a,b*. Thus, the diaphragm drive system 54 is arranged at an edge region of the diaphragm 12 and may comprise a toroid brass. The toroid brass arranged along the motion direction is configured change its length and/or its bend radius in order to subject the diaphragm 12 to a relative motion referring to the basket 52. For example, the drive system 54 or the toroid brass, respectively, may be formed by one or more electrical devices like piezoelectrical devices or by a bellow having a plurality of piezoelectrical devices integrated into same.

In this embodiment, the diaphragm suspension system 56 is integrated into the basket 52 and implemented as a cylinder liner which laterally surrounds the diaphragm 12 in order to guide same. According to further embodiments, the diaphragm suspension system 56 may comprise an element like a piston ring attached to the diaphragm 12 in order to reduce the friction between the cylinder liner 56 and the diaphragm 12.

Figure 6A:
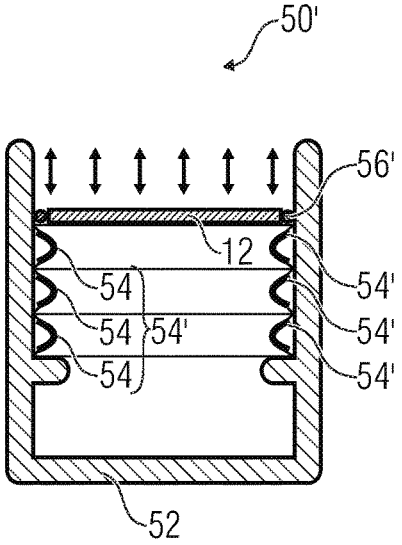
FIGS. 6*a,b* show schematic representations of an electroacoustic driver having a diaphragm, a basket, a diaphragm suspension formed by a cylinder liner and a diaphragm drive system formed by a bellow arranged between an edge region of the diaphragm and the basket.
Figure 6B:
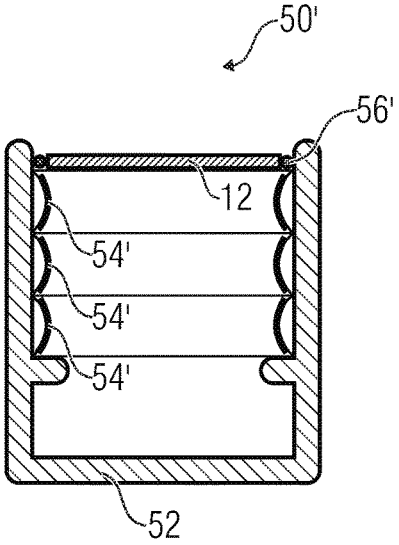

FIGS. 6*a* and 6*b* illustrate a further implementation of an electroacoustical device 50' which is substantially equal to the electroacoustical device 50 of FIGS. 5*a* and 5*b*. The electroacoustical device 50' comprises a plurality of drive systems 54 arranged in series such that a drive system 54' is formed. I.e. that the plurality of drive elements 54 are arranged to a bellow extending along the motion of the diaphragm 12. This enlarged drive system 54' has an enlarged diaphragm stroke when compared to the embodiment of FIGS. 5*a* and 5*b*. Therefore, the suspension system 56' formed as a cylinder liner is enlarged as well.

Figure 7A:
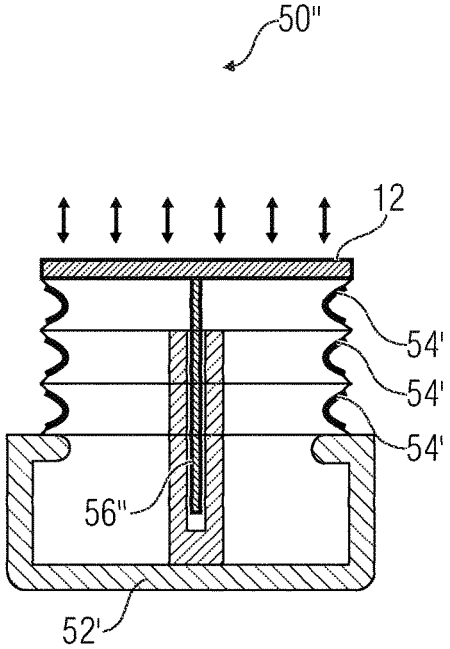
FIGS. 7*a,b* show schematic representations of an electroacoustic driver having a diaphragm, a basket, a diaphragm suspension formed by a piston element and a diaphragm drive system formed by a bellow arranged between an edge region of the diaphragm and the basket.
Figure 7B:
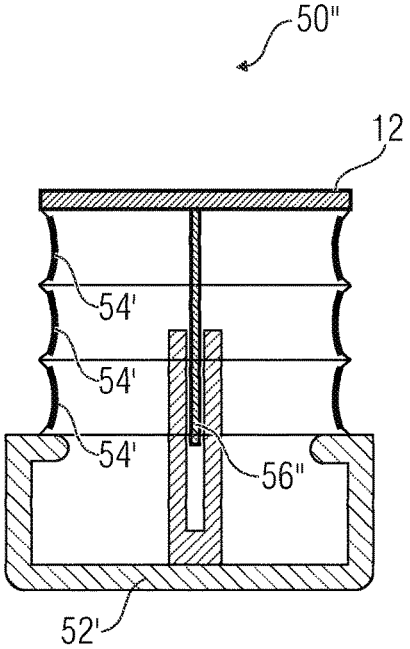

FIGS. 7*a* and 7*b* illustrate a further implementation of an electroacoustic device 50" comprising the enlarged drive system 54' for moving the diaphragm 12. In this implementation 50" the suspension system 56" formed as a pneumatic cylinder is coupled to the diaphragm 12 in the middle of same. Therefore, the basket 52' does not necessarily comprise the cylinder liner 54 guiding the diaphragm 12.

Referring to FIGS. 1 to 2, it should be noted that the active elements 18 having the purpose to compensate non-linearities may also be used for supporting the drive system. Thus, the active elements 18 may be configured to provide a force for subjecting the diaphragm 12 to a motion.

According to another embodiment, the active element 18 may be used for enlarging the stroke of the diaphragm 12. Here, a portion of the stroke is caused by the diaphragm drive system 14, wherein an additional portion of the stroke is caused by the active element 18. Regarding this embodiment it should be noted that the combination of the two drive systems for enlarging the stroke may cause additional non-linearities.

According to a further embodiment, the active element 18 may be used for defining the zero position of the diaphragm 12 which depends on the offset of the diaphragm drive system 14 and of the diaphragm suspension system 16. Background thereof is that the diaphragm suspension system 16 has a predetermined zero position (defined by the magnet), wherein the diaphragm suspension system 14 also has a predetermined zero position (defined by the stiffness of the suspension). Thus, if the zero positions of the two systems differ from each other it could be beneficial to adjust the offset of the whole system in order to operate the electroacoustic driver 10 within an optimized range. Thus, the active element 18 may be configured to cause a (static) deviation of the diaphragm 12 in order to offset same.

Although in above implementations some aspects of the electroacoustic device have been described in the context of a piston-like motion, it should be noted that the motion of the diaphragm may also be different, e.g. like a bending wave motion.

Although, the above embodiments of FIGS. 1 and 2*a-c* show the active element 18 advantageously arranged at an edge region of the diaphragm 12 or 12' (cf. surround 12*a*), it should be noted that the active elements 18 may also be arranged at the inner side, for example at the spider 16*b*. Alternatively, the spider 16*b* and the surround 16*a* may comprise the active elements.

Also, in some embodiments the active element 18 is illustrated as an element influencing the restoring force. It should be noted that the active element may also influence a material parameter, e.g. the stiffness of a component of the diaphragm suspension or a damping factor of same. I.e. that the active element 18 is configured to adapt the respective material parameter as a function of the excursion of the diaphragm 12.

Though in some embodiments the active element 18 has been described in context of a piezoelectrical device, it should be noted that the active element 18 may also be formed by a different (electrical) element or structure which may, for example, based on electromagnetic or electrostatic principles.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An electroacoustic driver, comprising:
a diaphragm;
a diaphragm drive system configured to subject the diaphragm to a motion;
a diaphragm suspension configured to guide the diaphragm; and
a controller;
wherein one or more active elements and/or piezo electrical elements are integrated into the diaphragm suspension or wherein the diaphragm suspension consists out of the one or more active elements and/or piezo electrical elements, wherein the one or more active elements and/or piezo electrical elements are configured to actively influence the motion of the diaphragm;
wherein the controller is configured to output a control signal to the diaphragm suspension based on a detected non-linearities and/or based on an audio signal via which the diaphragm drive system is controlled.

2. The electroacoustic driver according to claim 1, wherein diaphragm suspension is configured to change a restoring force dependent on an excursion of the diaphragm.

3. The electroacoustic driver according to claim 1, wherein the diaphragm suspension comprises a device for laterally guiding the diaphragm and/or a device for guiding the diaphragm along a direction of the motion.

4. The electroacoustic driver according to claim 1, wherein the surround comprises one or more active elements which are configured to change an offset of the diaphragm.

5. The electroacoustic driver according to claim 1, comprising a basket, wherein the surround is arranged between the basket and the diaphragm such that the surround guides and seals the diaphragm against the basket.

6. The electroacoustic driver according to claim 1, wherein the one or more active elements are radially arranged along the surround in order to provide a constant returning force.

7. The electroacoustic driver according to claim 1, comprising spider, which is configured to guide the diaphragm laterally and along a direction of the motion, comprises one or more active elements which are configured to actively influence the motion of the diaphragm.

8. The electroacoustic driver according to claim 1, comprising a spider, which is configured to guide the diaphragm laterally and along a direction of the motion, comprises one or more electrical devices which are configured to apply a force to the diaphragm in order to subject the diaphragm to the piston-like motion.

9. The electroacoustic driver according to claim 1, wherein the diaphragm drive system is configured to guide along a piston-like motion.

10. The electroacoustic driver according to claim 1, wherein the diaphragm is configured to act as a bending wave transducer.

11. The electroacoustic driver according to claim 1, wherein the diaphragm is supported by a surround comprising one or more electrical devices which are configured to actively influence the motion of the diaphragm.

12. The electroacoustic driver according to claim 1, wherein the active elements are coupled to the diaphragm drive system in order to control the electrical devices or piezo electrical devices via a control signal which is based on an audio signal via which the diaphragm drive system is controlled.

13. The electroacoustic driver according to claim 1, comprising a sensor attached to the diaphragm and/or to the diaphragm suspension for detecting non-linearities in the piston-like motion of the diaphragm.

14. The electroacoustic driver according to claim 1, wherein the sensor is formed by one of the active elements.

15. The electroacoustic driver according to claim 1, wherein the diaphragm exhibits a diameter larger than 0.5 inch to form a woofer or broad band driver.

16. The electroacoustic driver according to claim 1, wherein the driver is an electro-dynamic driver.

17. The electroacoustic driver according to claim 1, wherein the diaphragm drive system comprises a coil attached to the diaphragm and a magnet attached to a basket.

18. The electroacoustic driver according to claim 1, wherein the active element is configured to support the subjection of the motion of the diaphragm subjected by the diaphragm drive system or to enlarge the motion of the diaphragm subjected by the diaphragm drive system.

19. The electroacoustic driver according to claim 1, wherein diaphragm suspension exhibits a spring stiffness and is configured to change the spring stiffness and/or wherein diaphragm suspension is configured to adjust the restoring force counteracting to an excursion of the diaphragm.

20. An electroacoustic driver, comprising:

a diaphragm;

a diaphragm drive system configured to subject the diaphragm to a motion;

a diaphragm suspension configured to guide the diaphragm;

a sensor attached to the diaphragm and/or to the diaphragm suspension for detecting non-linearities in the piston-like motion of the diaphragm; and a controller configured to output a control signal to the diaphragm suspension based on the detected non-linearities and/or based on an audio signal via which the diaphragm drive system is controlled;

wherein the diaphragm suspension comprises a surround, the surround comprising one or more an active elements configured to actively influence the motion of the diaphragm in accordance to the control signal by changing a restoring force in accordance to the control signal or by applying a force to the diaphragm in accordance to the control signal;

wherein the control signal is based on an audio signal via which the diaphragm drive system is controlled, wherein the or more active elements comprise electrical devices or piezo electrical devices.

* * * * *